US007549643B2

(12) United States Patent
Quach

(10) Patent No.: US 7,549,643 B2
(45) Date of Patent: Jun. 23, 2009

(54) PLAYING CARD SYSTEM

(76) Inventor: Binh Quach, 1617 Mission Springs Cir., San Jose, CA (US) 95131

( * ) Notice: Subject to any disclaimer, the term of this patent is extended or adjusted under 35 U.S.C. 154(b) by 129 days.

(21) Appl. No.: 11/503,236

(22) Filed: Aug. 11, 2006

(65) Prior Publication Data

US 2007/0102878 A1 May 10, 2007

Related U.S. Application Data

(60) Provisional application No. 60/735,971, filed on Nov. 10, 2005.

(51) Int. Cl.
*A63F 3/06* (2006.01)

(52) U.S. Cl. ..... 273/293; 273/144 A

(58) Field of Classification Search ..... 273/148 R, 273/139, 144 A, 144 B, 148 A, 293; 283/901, 283/903; 206/449, 468
See application file for complete search history.

(56) References Cited

U.S. PATENT DOCUMENTS 2,185,624 A * 1/1940 Beck ..... 206/39
2,866,307 A * 12/1958 Rigg ..... 53/564
2,932,518 A * 4/1960 Burros ..... 273/293
4,298,200 A * 11/1981 Kanbar ..... 273/157 R
4,979,619 A * 12/1990 Hager ..... 206/509
5,190,297 A * 3/1993 Jessen et al. ..... 273/296
5,288,075 A * 2/1994 Kelley ..... 273/243
5,318,306 A * 6/1994 Levin ..... 273/293
5,522,163 A * 6/1996 Neugebauer ..... 40/780
6,053,497 A * 4/2000 Such ..... 273/138.1
6,851,556 B1 * 2/2005 Valdez et al. ..... 206/449
7,306,159 B1 * 12/2007 Rochelo ..... 235/492
D566,785 S * 4/2008 Quach ..... D21/396

* cited by examiner

*Primary Examiner*—William M Pierce

(57) ABSTRACT

A playing card system is disclosed comprising a face side displaying markings, which can be hidden and revealed by an adjustable barrier. A set of these playing cards may be used in the same games as those using a standard deck of cards. A shuffler randomizes the order and/or arrangement of the one or more sets through an agitation mechanism. The shuffling system allows for heightened randomization and secrecy of the markings, and minimizes opportunities for manipulation.

4 Claims, 5 Drawing Sheets

PLAYING CARD SYSTEM

CROSS REFERENCE TO RELATED APPLICATIONS

The present application claims the priority benefit of U.S. Provisional Patent Application Ser. No. 60/735,971, titled "Easy To Shuffle Playing Cards" and filed Nov. 10, 2005, which is incorporated herein by reference.

BACKGROUND OF THE INVENTION

1. Field of the Invention

This present invention relates, generally, to the field of gaming, and more particularly to playing cards used in games.

2. Description of Related Art

Various games require the use of one or more playing cards. While there are many possible variations of playing cards, a standard deck of playing cards generally consists of fifty-two playing cards, each with different markings. The fifty-two cards may be categorized by their markings into four different suits with thirteen ranks in each suit. The four suits are generally hearts, diamonds, spades, and clubs. The thirteen ranks are generally Ace (A), 2, 3, 4, 5, 6, 7, 8, 9, 10, Jack (I), Queen (Q), and King (K). The suits and ranks may have different values and/or significance in different games. Occasionally, a standard deck is packaged with one or more Joker cards.

Each playing card in a standard deck is generally constructed of a sheet of paper or plastic. One side, the face side, displays the suit and rank. The other side, the back side, generally does not indicate the markings on the face side. This back side may instead display a variety of designs. Possible designs may include a manufacturer's logo, a distributor's design, an artistic design, a novelty design, or any of various custom designs. In a standard deck of cards, all fifty-two cards generally display the same design on their back side.

Examples of games commonly played with at least one standard deck of playing cards includes poker, blackjack, bridge, gin rummy, go fish, and various others. Many of these card games may include elements of chance. To ensure a fair game in a game of chance, players must be dealt playing cards at random. Such randomization may be achieved through shuffling of the cards. Shuffling the playing cards randomly reorders a deck to produce a different permutation in the order of the playing cards of the deck, which contributes to the random distribution of playing cards to each player There are a variety possible shuffling techniques and a wide range in the quality of randomization resulting from these techniques. Good randomization of a deck of cards may require multiple shuffles using different shuffling techniques. Some games require that a deck be randomized multiple times throughout the course of the game or series of games. These multiple acts of randomization may consume a good deal of playing time. Furthermore, shuffling skills may vary from player-to-player due to differences in experience and/or manual dexterity. There are also many opportunities for mistakes, such as inadvertently revealing the markings on one or more cards during the act of shuffling. In the event of such a mistake, the exposed card may simply be returned to the deck, which may be shuffled again or subjected to more extensive shuffling to ensure the randomization of the deck. Some games and/or the players of the same may regard such mistakes very seriously. As such, some players may choose to abort the current game and start a new one as a result of the card exposure. In, the hands of an inexperienced and/or unskilled player, shuffling may be even more time-consuming than it already needs to be and possibly even disruptive to the game.

Inexperienced and/or unskilled shuffles may also result in poorly randomized cards. Poor randomization may decrease the chance element in games of chance, which may give some players an unfair advantage or disadvantage. Poor randomization may also affect a player's ability to bluff if other players can predict what cards he or she actually holds. The ability to bluff may be a very important part of the strategy in various card games (e.g., poker). Bluffing depends, in part, on restricting players from seeing or knowing the suit or rank of the playing cards dealt to their opponents. Dealing playing cards face-down may be one way to allow a player to access and see only his or her own playing cards. Different types of playing cards, decks of playing cards, and/or card games may utilize different systems of markings, shuffling, and/or dealing.

Another possible danger with respect to randomization is intentional and illicit manipulation of the cards by a player who is highly skilled at shuffling and/or dealing. A player with a stake in the outcome of the game may be capable of manipulating that outcome by deliberately shuffling and/or dealing the cards into a non-randomized and/or predictable order to achieve a predetermined, unfair result. To minimize manipulation, players may perform a procedure commonly referred to as 'cutting the deck.' After the deck is shuffled, a non-shuffling party may 'cut the deck' by selecting a random number of contiguous cards from anywhere in the deck and moving those cards elsewhere in the deck, while keeping all cards face-down. This procedure, when combined with shuffling and dealing, further adds to the time-consuming nature of ensuring proper randomization of the deck of cards, especially if shuffling, dealing, and cutting have to be performed multiple times. There is, therefore, a need for improved systems and methods for efficiently maintaining the randomness and secrecy of playing card distribution.

SUMMARY OF THE INVENTION

In various embodiments, the invention includes a playing card, with a face side displaying markings that are significant in a game. The invention, in various embodiments, further includes an adjustable barrier that shields the markings from view. The adjustable barrier helps to prevent opponents from accidentally and/or purposefully peeking at one's cards.

Some embodiments of the invention comprise one or more sets of fifty-two playing cards, each with adjustable barriers hiding the signifying markings on their face side. The markings on these sets of the invention may be the same as the markings on a standard deck of cards. Therefore, these sets may be used in the same and/or similar games as those utilizing one or more standard decks of cards.

Some embodiments of the invention further include a shuffler to be used with one or more sets. The shuffler randomizes the order and/or arrangement of the one or more sets through an agitation mechanism. Various embodiments of the agitation mechanism may include shaking, spinning, mixing, and others. The shuffling system of the invention minimizes manipulation by giving players the ability to hide the markings of the cards before it is placed in a shuffler and keeps them hidden during shuffling and dealing.

DETAILED DESCRIPTION

An exemplary embodiment of the present invention is a playing card with an adjustable barrier on the face side of the playing card. The barrier may be adjusted by a player to hide or reveal the markings (e.g., rank or suit) on the face side of the playing card. The markings on the face side of each card may have varying degrees of significance in terms of specific meaning, value, and/or status for a player in various games. Various embodiments of the present invention include one or more sets of these playing cards wherein the face side of each card is hidden by the adjustable barrier. Some embodiments of the present invention include at least one set of fifty-two playing cards with the same markings as a standard deck of cards.

In another embodiment of the present invention, at least one set of cards wherein the face side of the card is hidden by an adjustable barrier is shuffled in a shuffler by, for example, manually spinning the shuffler. Cards may then be dealt by a designated dealer from the shuffler, or the randomized cards may be chosen from the shuffler by the players themselves. A player can reveal the markings on his or her cards to themselves or any other appropriate party by adjusting the barrier on each card. For example, a player may slide the barrier open to review the cards that they have been dealt. At the end of the game (e.g. a hand of poker), the players can adjust the barriers on each card to reveal or again hide the card markings, and the cards may be placed back in the shuffler to be shuffled for the next game.

Figure 1B:
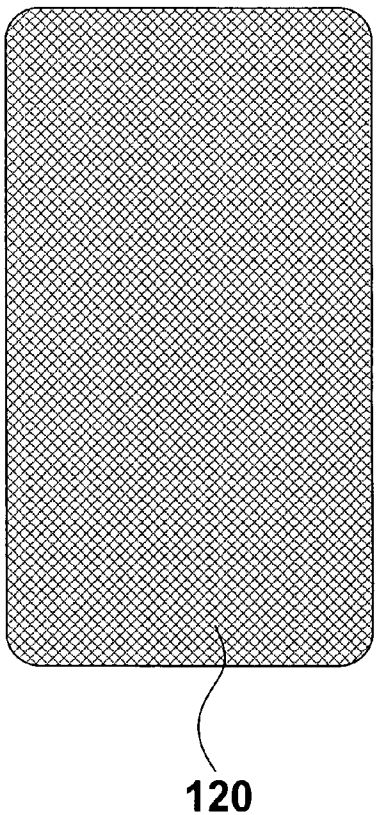
FIG. 1B (Prior Art)
FIG. 1B illustrates an example of a back side of a playing card as found in the prior art.
Figure 1A:
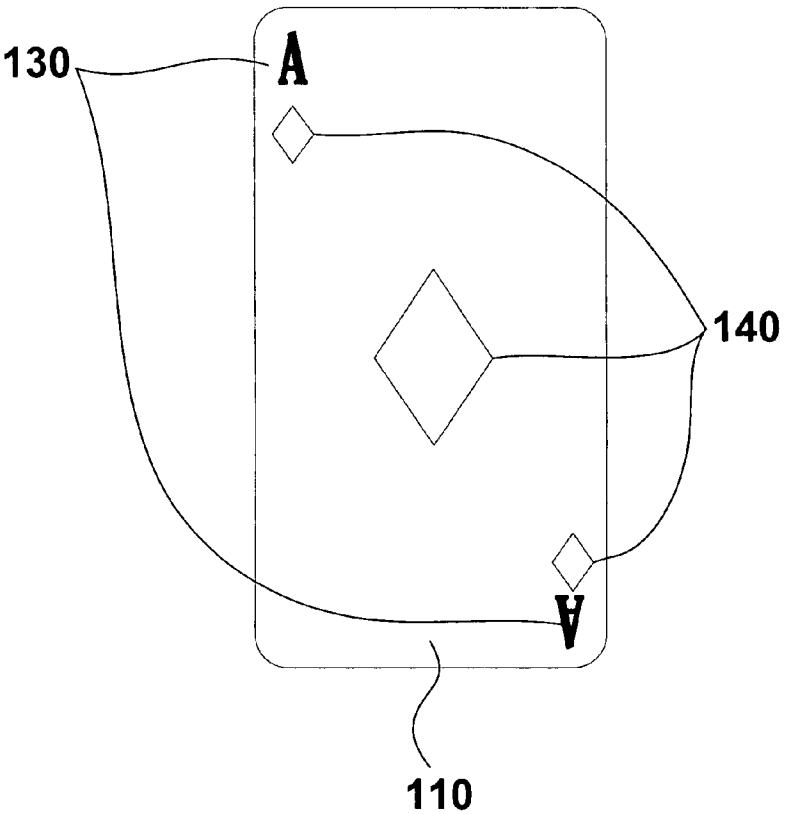
FIG. 1A (Prior Art)
FIG. 1A illustrates an example of a face side of a playing card as found in the prior art.

FIG. 1A illustrates an example of a face side 110 of a playing card from a standard deck of cards as may be found in the prior art. The face side 110 of a playing card typically displays markings that have some significance in a game. In a standard deck of cards, these markings include rank 130 and suit 140. FIG. 1B illustrates an example of a back side of a playing card as may be found in the prior art. The back side 120 of a card may display a design that has no particular significance in a game.

Figure 2A:
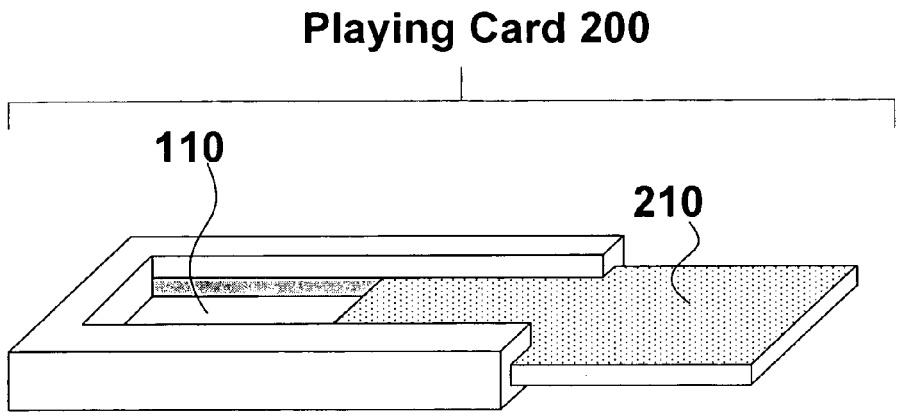
FIG. 2A illustrates a perspective view of an exemplary encased playing card system, according to various embodiments of the present invention.
Figure 2B:
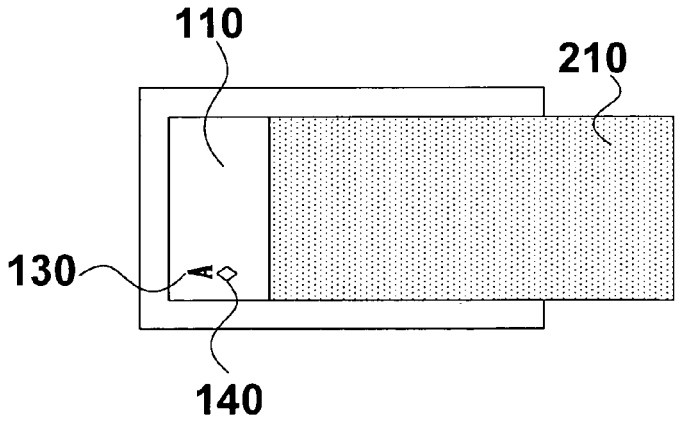
FIG. 2B illustrates a plan view of the front of an exemplary encased playing card system, according to various embodiments of the present invention.

FIG. 2A illustrates a perspective view of an exemplary encased playing card system, according to various embodiments of the present invention. Playing card 200 comprises a face side 110 of a card, a back side 120 of a card, and further includes an adjustable barrier 210 that may hide markings on the face side 110. FIG. 2B illustrates a plan view of the front of an exemplary encased playing card, according to various embodiments of the present invention. As illustrated in FIG. 2B, the adjustable barrier 210 can be adjusted to reveal the markings of the playing card, including rank 130 and suit 140, if any, on the face side 110 of the playing card 200.

Figure 2C:
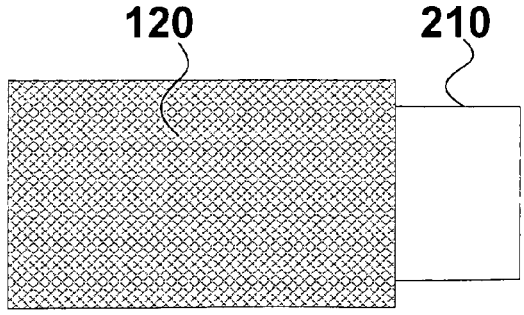
FIG. 2C illustrates a plan view of the back of an exemplary encased playing card system, according to various embodiments of the present invention.

In the embodiment depicted in FIGS. 2A-C, the barrier 210 is a sliding lid of an encased playing card system 200. The playing card system 200 in the presently illustrated embodiment may comprise grooves that conform to the shape and size of the barrier 210. The barrier 210 may be configured to slide back and forth easily in the aforementioned grooves. The face side 110 is an interior side of the playing card system 200. The markings, which may include rank 130 and/or suit 140, on the face side 110 may be visible only when the barrier 210 is adjusted to certain positions. In other positions, the markings on the face side 110 may be hidden.

FIG. 2C illustrates a plan view of the back of an exemplary encased playing card system 200, according to various embodiments of the present invention. The back side 120 is the underside of the playing card system 200. Any design that could be displayed on a back side of a standard playing card can be displayed on the back side 120 of the playing card system 200 according to the various embodiments of the present invention. Further, any of those designs can also be displayed on the barrier 210.

In the embodiment illustrated in FIGS. 2A-C, the playing card system 200 is shaped like a rectangular prism when it is in a closed position. A closed position includes, for example, one where the markings on the face side 110 of the playing card system 200 are completely hidden. Other embodiments of playing card system 200 may include different shapes and sizes. The sides and/or corners of the playing card system 200 may be curved, such as, for example, in the embodiment illustrated in FIG. 3A.

Figure 3A:
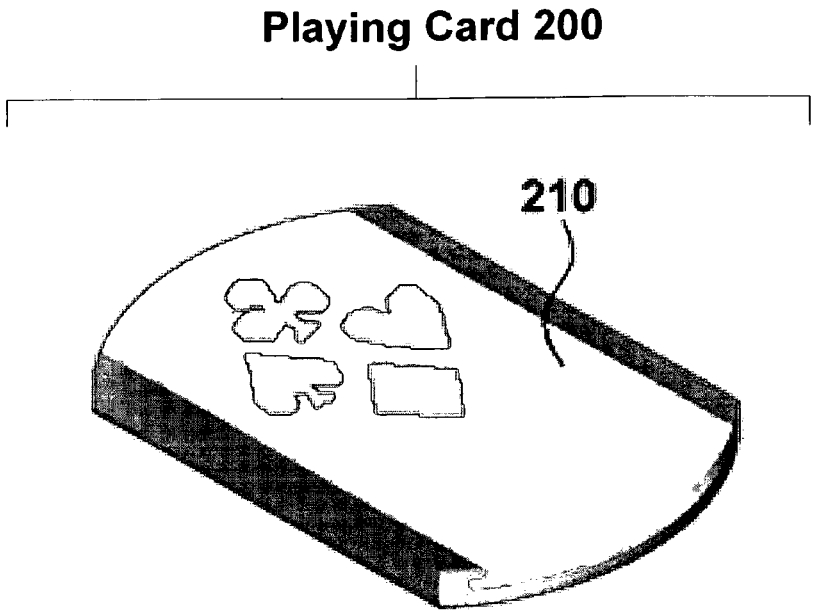
FIG. 3A illustrates a perspective view of another exemplary encased playing card, according to various embodiments of the present invention.
Figure 3B:
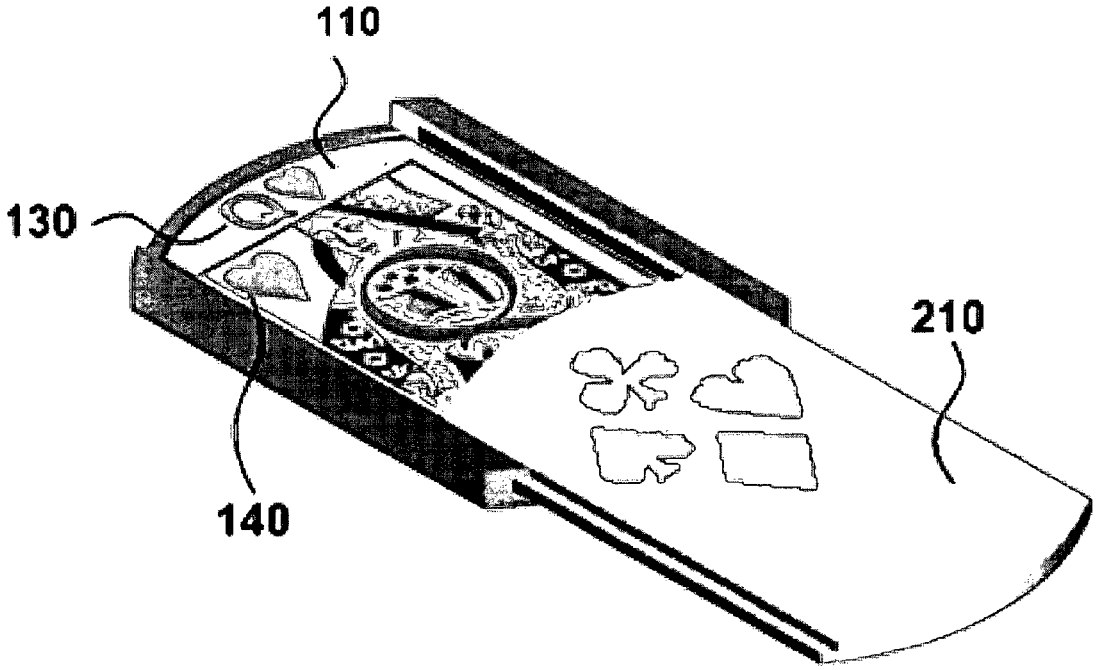
FIG. 3B illustrates a perspective view another exemplary encased playing card, where the barrier has been adjusted, according to various embodiments of the present invention.

FIG. 3A illustrates a perspective view of another exemplary encased playing card system 200, according to various embodiments of the present invention. In FIG. 3A, the barrier 210 is fixed in a closed position in the context of the playing card 200. FIG. 3B illustrates a perspective view of another exemplary encased playing card system 200, where the barrier 210 has been adjusted to reveal the face side 110 of the playing card system 200.

Figure 4A:
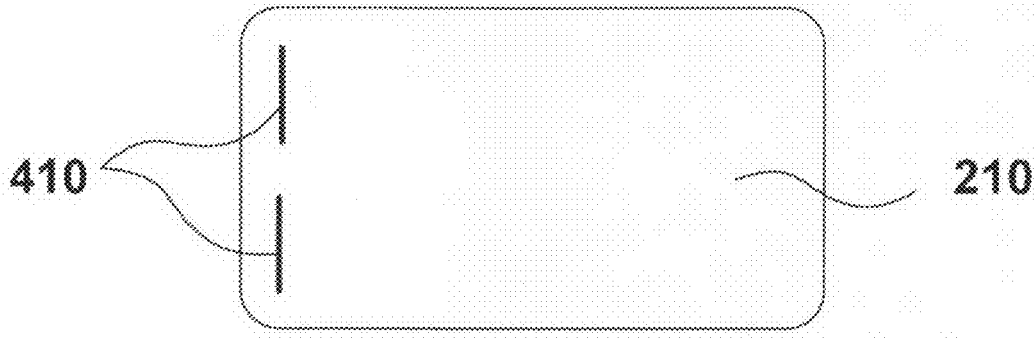
FIG. 4A illustrates a notched lid of an exemplary encased playing card system, according to various embodiments of the present invention.

FIG. 4A illustrates a notched lid of an exemplary encased playing card system 200, according to various embodiments of the present invention. In the presently illustrated embodiment, the sliding lid barrier 210 comprises a notch 410, located on the underside of the barrier 210. In various embodiments, the notch 410 may appear in a variety of shapes, sizes, depths, and/or locations on the barrier 210. In the embodiment pictured in FIG. 4A, the notch 410 is configured as a raised line along the underside of the barrier 210. However, other embodiments may include different shapes, sizes, depths, and/or positions. Various embodiments of a notch 410 may also include different depths ranging from protrusion to indentation on the barrier 210.

Figure 4B:
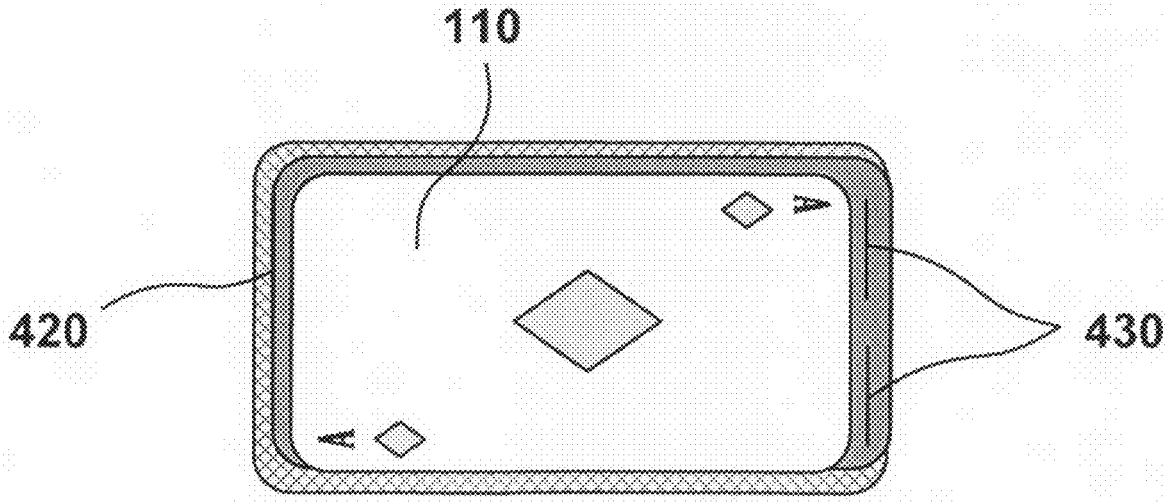
FIG. 4B illustrates a closing edge and a stopping edge on an exemplary encased playing card system, according to various embodiments of the present invention.

FIG. 4B is an illustration of an embodiment of a portion of the playing card system 200 wherein barrier 210 is not pictured for ease of illustration. In the embodiment pictured in FIG. 4B, the playing card system 200 further comprises a closing edge 420. The closing edge 420 and notch 410 can coordinate to fix the barrier 210 in a closed position in the context of the playing card system 200. Like notch 410, the closing edge 420 may be expressed differently in various embodiments, for example, in different shapes, sizes, depths, and/or locations on the barrier 210. The configuration of the closing edge 420 corresponds to the configuration of notch 510 to hold the barrier 210 closed. The notch 410 and closing edge 420 should be able to respond to user adjustment with minimal effort on the user's part. A user should be able to easily adjust the barrier 210 into and out of a closed position with a minimal degree of physical effort but not so little effort that the barrier 210 inadvertently comes open during, for example, the act of shuffling.

FIG. 4B further illustrates a stopping edge 430 on playing card system 200. The stopping edge 430 works with a notch 410 to prevent further user adjustment away from closed position. Like the closing edge 420, the stopping edge 430 may be configured differently in various embodiments, for example, in different shapes, sizes, positions, and/or depths. The configuration of the stopping edge 430 corresponds to the configuration of notch 410 to stop the barrier from adjusting further away from closed position. In embodiments where the barrier 210 is a sliding lid, a notch 410 and a stopping edge 430 prevent the barrier 210 from sliding completely out and detaching completely. The stopping edge 430 accomplishes this by catching the notch 410 before that detachment can happen and stopping the barrier 210 from adjusting towards positions where detachment can occur.

In some embodiments, the barrier 210 may be a pivoting lid. In such an embodiment, a stopping edge 430 would only allow the barrier 210 to pivot within certain ranges around an axis. In various embodiments, a stopping edge 430 may work with a different notch on the barrier 210 than the notch working with a closing edge 420. Various embodiments may also include multiple notches 410, closing edges 420, and stopping edges 430. Other embodiments are envisioned including, for example, a hinged lid.

Figure 5B:
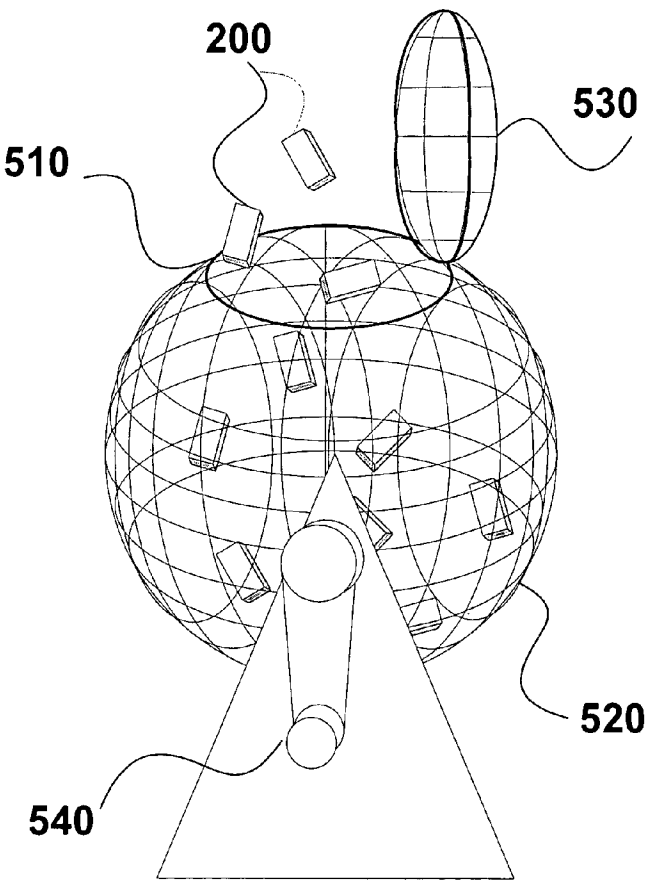
FIG. 5B illustrates an exemplary shuffling system, according to various embodiments of the present invention.
Figure 5A:
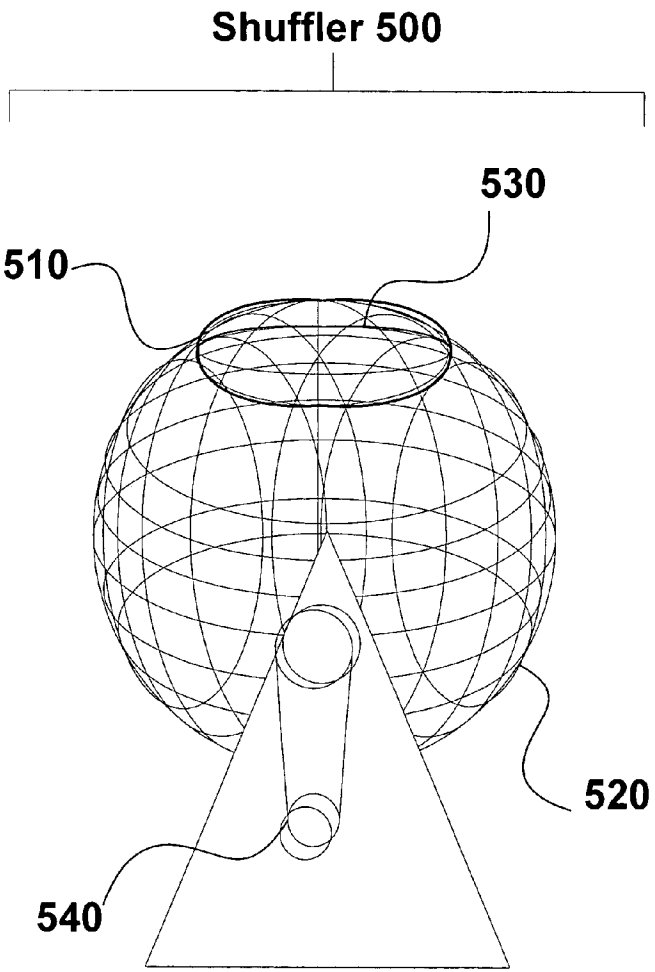
FIG. 5A illustrates an exemplary shuffler as may be implemented in various embodiments of the present invention.

FIG. 5A illustrates an exemplary embodiment of a shuffler 500. A shuffler 500 comprises a body 520 configured to hold multiple shuffling playing card systems (200), an opening 510 large enough for a playing card system 200 to enter and exit the body 520, and an agitation mechanism 540. FIG. 5A illustrates a large spherical cage embodiment. In various other embodiments, the body 520 may be configured differently in different shapes, sizes, and transparencies. For example, the body 520 may be an opaque cylinder capable of shuffling hundreds of playing card systems 200; it may also be a clear cube capable of shuffling only one set of fifty-two playing card systems 200.

In the shuffling system illustrated in FIG. 5B, playing card systems 200 enter the body 520 through an opening 510. The opening 510 may be configured differently in various embodiments, such as different shapes and sizes. In the illustrated embodiment, the opening 510 appears as a round hole in the body 520 of the shuffler 500. Other embodiments of the opening 510 may include a slot or a funnel. Some embodiments of the invention may further comprise a door 530 to cover the opening 510. The agitation mechanism 440 is a mechanism that randomly rearranges the plurality of playing card systems 200 contained in the body 520 of the shuffler 500.

Various embodiments of the shuffler 500 may comprise various agitation mechanisms 440, which shuffle by shaking, spinning, mixing, and/or various other ways of rearranging the playing card systems 200. With a traditional deck of playing cards as may be found in the prior art, such a shuffler 500 or agitation mechanism 540 could not be used, as to do so would result in the exposure of various markings on a playing card. This exposure would eradicate the unpredictability and/or secrecy that are important elements in many card games. These problems are solved by the barrier 210 component of the playing card system 200, which prevents exposure of the markings, which may include rank 130 and suit 140, on the face side 110 of the playing card system 200, while still allowing for varied options in shuffling. Significantly, embodiments of the present invention allow for quick and efficient methods of shuffling even in the absence of traditional shuffling skills and/or dexterity.

In many casinos and home games, various card games require that someone shuffle and deal the cards. With dealers, there is always a danger of dealer manipulation and/or mistake. A skilled dealer may be able to deal one or more known cards from anywhere in the deck; and an unskilled dealer may deal a player too many or too few cards or flip cards over inadvertently. If anyone sees markings that he or she is not supposed to, an unfair advantage or disadvantage may arise. Dealer manipulation and/or mistake may be minimized by the shuffler 500, because the dealer does not handle the playing card systems 200 directly. Because dealer manipulation is minimized, the need for a cut is also reduced. Because the markings of the playing card systems 200 can be kept secret before, during, and after a shuffle, the shuffling system further allows each player to choose his or her next playing card system 200. This may introduce an additional randomization element to the randomization created by one or more shuffles in a shuffler 500.

The embodiments discussed herein are illustrative. These embodiments are described with reference to illustrations; various modifications or adaptations of the methods and or specific structures described may be apparent to those skilled in the art. All such modifications, adaptations, or variations that rely upon the teachings herein, and through which these teachings have advanced the art, are considered to be within the spirit and scope of the various embodiments. Hence, these descriptions and drawings should not be considered in a limiting sense, as it is understood that the present invention is in no way limited to only the embodiments illustrated.

What is claimed is:

1. A playing card kit comprising fifty-two playing card cases, wherein each of the fifty-two card cases associated with markings indicating one of thirteen ranks and further indicating one of four suits, the thirteen ranks comprising Ace, 2, 3, 4, 5, 6, 7, 8, 9, 10, Jack, Queen, and King, the four suits comprising hearts, diamonds, clubs, and spades, each card case comprising:

an interior face side of the card case, the face side displaying the markings having value in a game;

a barrier lid of the card case, the barrier hiding the markings on the interior face side, wherein the barrier is openable to reveal the markings on the interior face side and reclosable to hide the markings; and a closing edge configured to secure the barrier in a closed position such that the markings remain hidden during shuffling via agitation.

2. The kit of claim 1, wherein each card case in the kit further comprises a notch configured to operate in conjunction with the closing edge to secure the barrier in the closed position.

3. The kit of claim 1, wherein each card case in the kit further comprises a stopping edge configured to operate in conjunction with the notch to limit adjustment of the barrier to a predetermined range.

4. The kit of claim 3, wherein the playing card kit further comprises at least one card case associated with markings indicating a joker.

* * * * *